United States Patent [19]

Fukuzawa et al.

[11] 4,178,532

[45] Dec. 11, 1979

[54] ELECTRON GUNS FOR USE IN CATHODE RAY TUBES

[75] Inventors: Kenichi Fukuzawa, Mobara; Kunio Ando, Yokohama; Masakazu Fukushima, Kokubunji, all of Japan

[73] Assignee: Hitachi, Ltd., Tokyo, Japan

[21] Appl. No.: 843,454

[22] Filed: Oct. 19, 1977

[30] Foreign Application Priority Data

Oct. 22, 1976 [JP] Japan ..... 51-126041

[51] Int. Cl.[2] ..... H01J 29/50

[52] U.S. Cl. ..... 313/414; 313/449; 313/460; 315/15

[58] Field of Search ..... 313/414, 412, 448, 449, 313/458, 460; 315/14–16

[56] References Cited

U.S. PATENT DOCUMENTS

| | | | |
|---|---|---|---|
| 3,895,253 | 7/1975 | Schwartz et al. | 313/449 X |
| 3,919,583 | 11/1975 | Hasker et al. | 313/414 X |
| 3,987,329 | 10/1976 | Yamazaki et al. | 313/449 |
| 4,052,643 | 10/1977 | Yamazaki et al. | 313/449 X |

*Primary Examiner*—Robert Segal
*Assistant Examiner*—Darwin R. Hostetter
*Attorney, Agent, or Firm*—Charles E. Pfund

[57] ABSTRACT

In a unipotential type electron gun including a main lens constituted by three coaxial and spaced apart electrodes for focusing an electron beams, the length of the intermediate electrode is made to be larger than 1.1D, where D represents the inner diameter of the electrodes on both sides, and the sum of the length of one electrode located on the side of a cathode electrode, the length of the intermediate electrode, the gap length therebetween, and the gap length between the intermediate electrode and the electrode on the opposite side is set to be in a range of from 4.0D to 5.4D.

7 Claims, 8 Drawing Figures

ELECTRON GUNS FOR USE IN CATHODE RAY TUBES

BACKGROUND OF THE INVENTION

This invention relates to an electron gun for use in cathode ray tubes and especially an electron gun of unipotential type.

The electron gun of this invention is applicable to known monochromatic and/or color cathode ray tubes of television receiving sets. As is well known in the art, the envelope of the cathode ray tube of this type is constituted by a panel, a funnel and a neck. On the inner surface of the panel is formed a phosphor screen upon which an electron beam impinges to cause the phosphor screen to luminesce. Inside the neck is provided an electron gun including a plurality of electrodes which emits an electron beam of the desired intensity under the control of video signals. Typically, a color picture tube contains in its neck three electron guns for emitting three electron beams. Within the panel is supported a color selection electrode or a shadow mask having a plurality of apertures for passing the electron beams. These apertures have a predetermined configuration and arranged in the form of a predetermined pattern. On the inner surface of the panel of a color picture tube is formed a phosphor screen containing phosphors for causing red, green and blue color luminescences, these phosphors being arranged in a pattern which is determined by the arrangement of electron guns and the color selection electrode apertures of the predetermined configuration.

The electron gun comprises an electron beam emitting member which emits a controlled amount of an electron beam under the control of an external control signal, for example a video signal, and a group of electrodes which constitutes a main electron lens for focusing the electron beam on the phosphor screen.

Especially, in a unipotential type electron gun, the electrode group constituting the main lens comprises three cylindrical electrodes which are arranged coaxially with predetermined gaps therebetween. The same anode voltage is impressed upon the electrodes on both sides of the assembly whereas a suitable focusing voltage is impressed upon the intermediate electrode, these electrodes greatly governing the focusing characteristic of the electron gun.

However, in the prior art unipotential type electron gun, the length of the intermediate electrode is shorter than that of the electrodes on both sides and the focusing voltage applied to the intermediate electrode is usually set to be substantially zero. With such electron gun, there are such defects that the spherical abberration is large and the beam spot diameter is not sufficiently small in a practical range of current.

Above description refers to the defects of the unipotential type electron gun for use in a monochromatic cathode ray tube, but the unipotential type electron gun assembly for use in a color picture tube wherein three electron guns each having a similar construction to that of the monochromatic cathode ray tube has also the same defects.

SUMMARY OF THE INVENTION

It is an object of this invention to provide an improved unipotential type electron gun for use in a monochromatic and/or color picture tube.

Another object of this invention is to provide an improved electron gun for use in a cathode ray tube having a small spherical aberration and capable of producing a small electron beam spot over the entire range of the current under a definite focusing voltage.

According to this invention these and further objects can be accomplished by providing a unipotential type electron gun for use in a cathode ray tube of the class comprising an electron emitting member which emits an electron beam of a controlled intensity under the control of an external control signal, a main electron lens adapted to focus the electron beam and constituted by three cylindrical electrodes which are disposed coaxially with predetermined gaps therebetween and wherein the same anode voltage is impressed upon the electrodes on both sides and a predetermind fixed focusing voltage is impressed upon an intermediate electrode, characterized in that the length of the intermediate electrode is set to be larger than 1.1 D, where D represents the inner diameter of the electrodes on both sides, and that the sum of the length of one electrode located on the side of the electron emitting member, the length of the intermediate electrode, the gap length therebetween, and the gap length between the intermediate electrode and the electrode on the opposite side is set to be within a range of from 4.0 D to 5.4 D.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENTS

Figure 1:
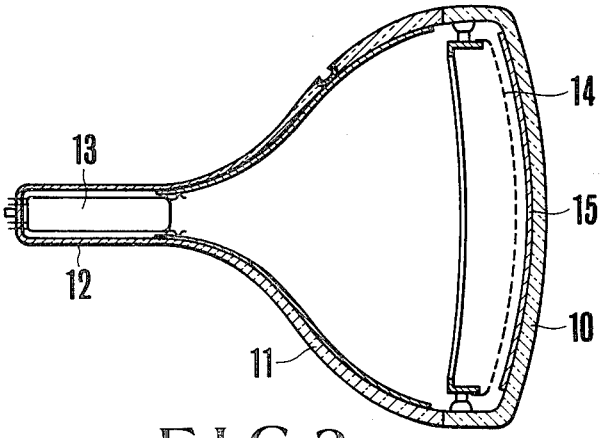
FIG. 1 is a longitudinal sectional view diagrammatically showing one example of a cathode ray tube to which the electron gun of this invention is applicable.
Figure 2:
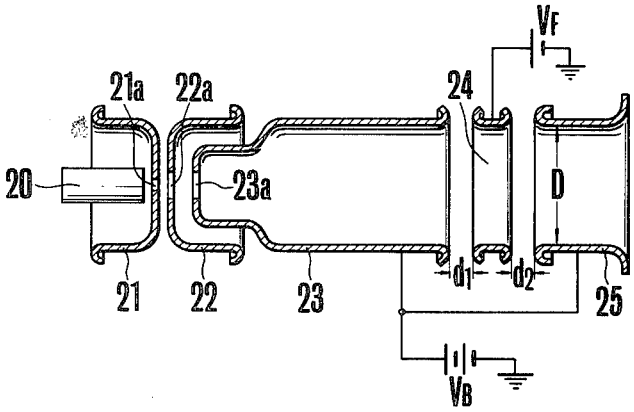
FIG.2 (PRIOR ART)
FIG. 2 is a longitudinal sectional view showing the outline of a prior art unipotential type electron gun.

To aid better understanding of this invention, before describing preferred embodiments of this invention, the outline of a cathode ray tube in which the electron gun of this invention is to be incorporated and one example of a prior art unipotential type electron gun will firstly be described by referring to FIGS. 1 and 2. As diagrammatically shown in FIG. 1, a cathode ray tube comprises an envelope including a panel or face plate 10, a funnel 11 and a neck 12. Inside the neck 12 is disposed an electron gun 13 adapted to emit an electron beam. A phosphor screen 15 is formed on the inner surface of the panel 10 for receiving an electron beam of a desired intensity which is emitted by the electron gun and controlled by an external control signal for causing the phosphor of the screen to luminesce at a desired brightness. In a color picture tube of a television receiving set, a color selection electrode 14 having a plurality of apertures for passing the electron beam is mounted close to the phosphor screen 15, and the phosphor screen is made up of phosphors for emitting three colors, whereby when irradiated by three electron beams emitted by an electron gun assembly including three electron guns, the phosphors emit red, green and blue lights as well known in the art.

As the electron gun 13, a unipotential type electron gun is frequently used because of a relatively simple construction of the electrode group constituting the main lens. FIG. 2 diagrammatically shows one example of a prior art unipotential type electron gun for use in a monochromatic cathode ray tube. As shown, a cathode electrode 20 and first to fifth grid electrodes 21 through 25 each having the same inner diameter are coaxially supported by a supporting member, not shown, with suitable gaps therebetween. The cathode electrode 20, and the first and second grid electrodes 21 and 22 constitute an electron emission member which controls the intensity of the emitted electron beam when applied with such an external control signal as a video signal in a manner well known in the art. A group of three electrodes including the third to fifth grid electrodes 23, 24 and 25 constitutes a main lens. The fifth and third grid electrodes 25 and 23 on both sides are impressed with the same anode voltage $V_B$ while the intermediate fourth grid electrode 24 is supplied with a focusing voltage $V_F$, the dimensions of these electrodes greately governing the focusing characteristic of the electron gun.

Apertures 21*a* and 22*a* of the first and second grid electrodes 21 and 22 are disposed to face the electron emitting surface of the cathode electrode 20 and the entrance aperture 23*a* of the third grid electrode 23 is disposed in coaxial relationship with apertures 21*a* and 22*a*. The exit aperture of the third grid electrode 23, the entrance and exit apertures of the fourth grid 24, and the entrance aperture of the fifth grid electrode 25 have the same diameter as the inner diameter of these cylindrical grid electrodes. The gap $d_1$ between the third and fourth grid electrodes 23 and 24 and the gap $d_2$ between the fourth and fifth grid electrodes 24 and 25 are necessary for constituting the main lens and usually have a length of less than 2 mm, preferably 1 mm. If these gaps are larger than 2 mm, the external field adversely affects or disturbs the electric field produced by the main lens.

In the conventional unipotential type electron gun shown in FIG. 2, as the length of the fourth grid electrode 24 increases, the spherical aberration decreases while at the same time the focusing voltage $V_F$ necessary to suitably focus the electron beam increases. We have made various experiments in which the length of the third and fourth grid electrodes 23 and 24 was varied variously.

Figure 3:
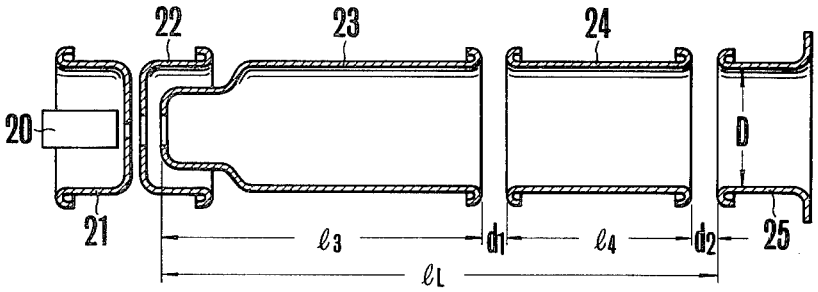
FIG. 3 is a longitudinal sectional view showing the outline of one example of the unipotential type electron gun embodying the invention.

The result of experiments made on one embodiment of the unipotential type electron gun of this invention will now be described with reference to FIGS. 3, 4A and 4B. In FIG. 3, elements corresponding to those shown in FIG. 2 are designated by the same reference charactors. For the sake of brevity, although sources of the focusing voltage and the anode voltage and the connections thereof are not shown, it should be understood that they are identical to those shown in FIG. 2.

The electron gun shown in FIG. 3 is different from that shown in FIG. 2 in that the fourth grid electrode 24 shown in FIG. 3 is longer than the fourth grid electrode shown in FIG. 2, and that the length of the third grid electrode 23 is selected to a value corresponding to the length of the fourth grid electrode 24. For the reason described above, again the gap lengths $d_1$ and $d_2$ are less than 2 mm, preferably 1 mm.

In the unipotential type electron gun shown in FIG. 3, as the length $l_4$ of the fourth grid electrode 24 increases, the spherical aberration decreases and such decrease reaches a limit when the length becomes 1.1 time the inner diameter D of the grid electrode. Within this limit, a small beam spot diameter was obtained for a certain value of beam current (intensity of the beam).

Figure 4A:
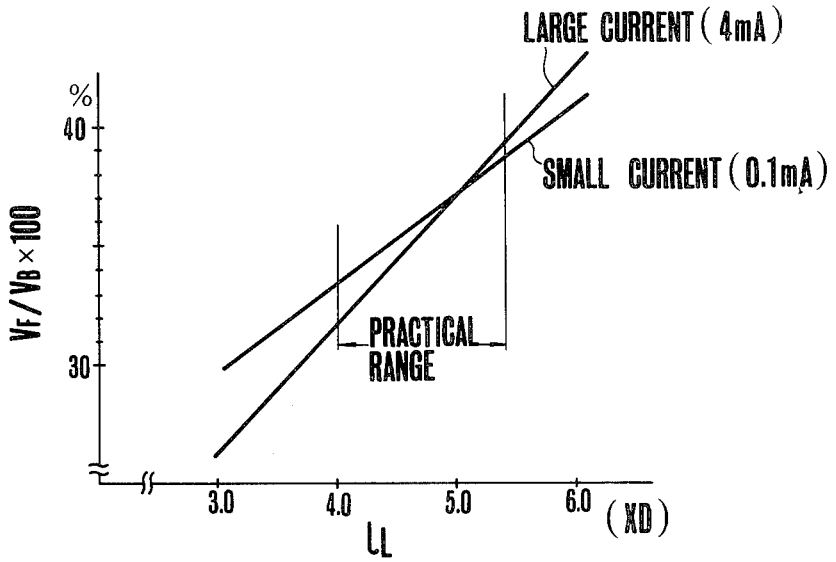
FIG. 4A is a graph showing the relationship between the electrode length of the unipotential type electron gun and the focusing voltage.
Figure 4B:
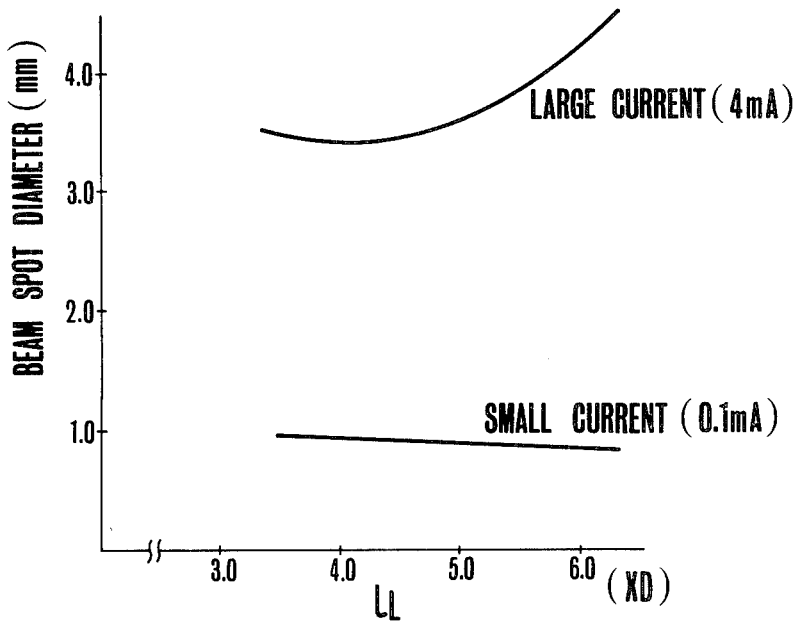
FIG. 4B is a graph showing the relationship between the electrode length of the unipotential type electron gun and the beam spot diameter.

The relationship between the electrode length $l_4$ and the beam spot diameter was determined experimentally as shown by a graph shown in FIG. 4B in which the abscissa represents the total length in terms of multiple of the inner diameter D of the grid electrode which corresponds to the sum $l_L$ of the length $l_3$ of the third grid electrode 33, gap length $d_1$, the length $l_4$ of the fourth grid electrode 34, and the gap length $d_2$. A preferred value of the inner diameter D ranges from 3.5 to 20 mm, and the length $l_4$ was selected to be $l_4=2.5$ D for D=5.5 mm. Furthermore, $V_B=20$ KV was used.

As shown in FIG. 4B, for a large current of 4 mA, the beam spot diameter becomes minimum at a total length $l_L=4.0$ D, whereas at a small current of 0.1 mA, the beam spot diameter decreases as the total length $l_L$ increases.

The graph shown in FIG. 4A shows the relationship between the focusing voltage and the total length $l_L$ in which the ordinate represents the ratio of the focusing voltage to the anode voltage and the abscissa shows the total length $l_L$ in terms of the multiple of the inner diameter D. Two straight lines show the relationship between $l_L$ and $V_F/V_B\times 100$ which gives the minimum beam spot diameter for constant currents of 4 mA and 0.1 mA, respectively. The minimum beam spot diameter varies depending upon the values of $l_L$ and $V_F/V_B\times 100$. More particularly, the minimum beam spot diameter is different for $l_L=3.0$ and $l_L=4.0$ so that the focusing voltage is adjusted such that the minimum but different beam spot diameters may be obtained for $l_L=3.0$ and $l_L=4.0$. The values of $V_F$ thus obtained were plotted. As shown in FIG. 4A, near $l_L=5.0$ D a minimum beam spot diameter corresponding to 37% of $V_F$ was obtained for both the large and small currents (this holds true for currents between these maximum and minimum current values). When $V_F$ deviates from 37%, the focusing voltage depends on the intensity of beam current and cannot be determined to a fixed value.

A circuit would be sophisticated which can provide an optimum value of beam spot diameter by varying the focusing voltage corresponding to the beam current and such a circuit is not practical. Accordingly, for the electron gun of the above described type, it is necessary to select a value of $l_L$ that can manifest satisfactory characteristic for a constant $V_F$. The reason that the focusing voltage $V_F$ varies with the value of current is that the spreading of the electron beam about the axis and the affect of repulsion of the space charge caused by the value of the current elongate the focal length of the electron lens whereas increase in the spherical aberration shortens the focal length so that when these two effects become unbalanced the focusing voltage varies.

In the main electron lens of this invention, although the spherical aberration differs depending upon the length of the fourth grid electrode, the spherical aberration of the lens is governed so long as $l_4 \geqq 1.1$ D by the spreading of the beam diameter in the main lens which, in turn, is determined by the length $l_L$. Consequently, as the length $l_4$ increases the spreading of the beam in the main lens and hence the spherical aberration increases so long as $l_4 \geqq 1.1$ D. The practical range of $l_L$ is 4.0 D $\leqq l_L \leqq 5.5$ D. The length $l_3$ has a lower limit of the order of D for its capability of production. Although having been described hereinbefore that the first to fifth grid electrodes have the same inner diameter, it is not essential according to the invention that all the grid electrodes have the same inner diameter. The inner diameters of the first and second grid electrodes may be different from those of the third to fifth grid electrodes. Also, an experiment shows that the inner diameter of the fourth grid electrode may be D±0.3 D.

Accordingly, when the electron lens is constituted by grid electrodes having dimensions described above, the spherical aberration is reduced so that it is possible to obtain a beam spot having a small diameter with a fixed focusing voltage over the entire current range. Consequently, it is possible to decrease the beam spot diameter by about 20 to 30% as compared with the prior art electron gun.

Figure 5:
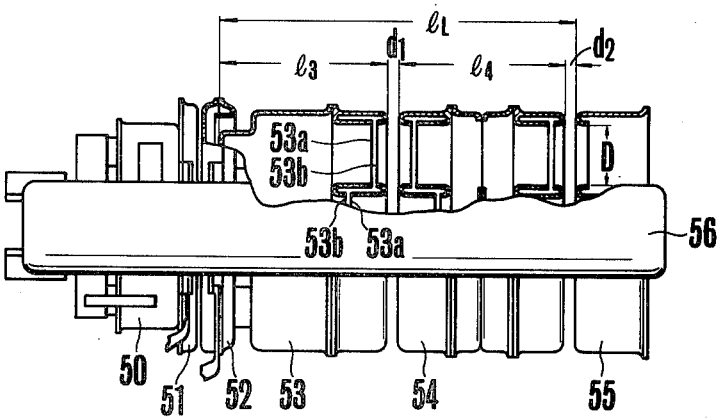
FIG. 5 is a side view, partly broken, showing the outline of one embodiment of this invention applied to an in-line type electron gun of a color picture tube.
Figure 6A:
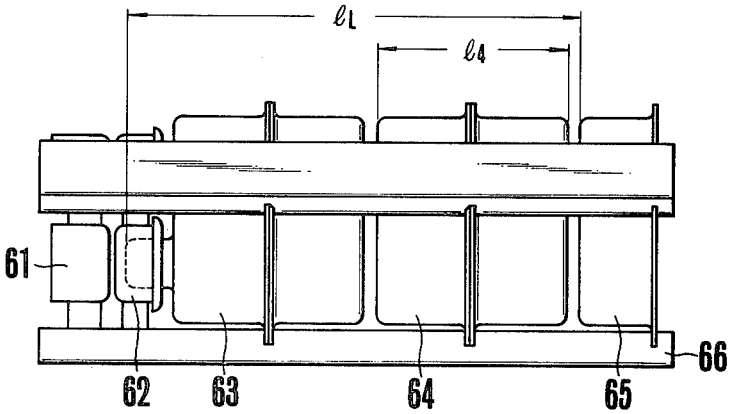
FIG. 6A is a side view showing the outline of another embodiment of this invention as applied to a delta type electron gun of a color picture tube.
Figure 6B:
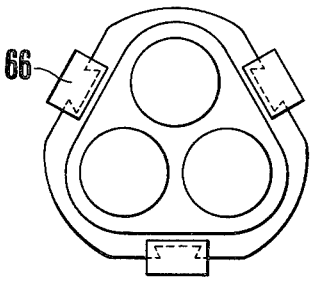
FIG. 6B is a front view of FIG. 6A.

Turning to FIGS. 5, 6A and 6B, the invention will be described by way of unipotential type electron gun assemblies for use in color picture tubes. Especially, FIG. 5 shows one example of in-line type unipotential electron gun assembly and FIGS. 6A and 6B show one example of delta type unipotential electron gun assembly.

As diagramatically shown in FIG. 5, the in-line type unipotential electron gun assembly comprises three electron guns arranged in line in which first to fifth grid electrodes associated with respective three electron guns, that is, for red, blue and green colors are each assembled in the form of an integral electrode as designated by 51, 52, 53, 54 and 55. Typically, a deep cup-shaped electrode 53*a* and a shallow cup-shaped electrode 53*b* are combined to constitute an electrode for one electron gun. The array of these cup-shaped electrodes for the central electron gun is reversed with respect to that for electron guns on both sides so that electric fields for three electron guns are uniformed. The grid electrodes 51 to 55 together with cathode 50 are supported coaxially by supporting beams 56. Although not shown, an anode voltage is supplied to the third and fifth grid electrodes 53 and 55 and a focusing voltage is supplied to the fourth grid electrode 54 to thereby establish a main electron lens.

With this construction, when the length $l_4$ of the fourth grid electrode, that is, intermediate electrode is selected to be $l_4 \geqq 1.1$ D, where D is the inner diameter of opening of electrode associated with one electron gun, and the total length $l_L$ is selected to be in a range of from 4.0 D to 5.4 D, the same effect as in the embodiment of FIG. 3 can be obtained.

In FIGS. 6A and 6B, three electron guns are arranged in a delta configuration and first grid electrodes 61, second grid electrodes 62, an integral third grid electrode 63, an integral fourth grid electrode 64 and an integral fifth grid electrode 65 are supported by supporting beams 66. In this embodiment, the same effect as in the embodiment of FIG. 3 can be attained when $l_4 \geqq 1.1$ D and 4.0 D $\leqq l_L \leqq 5.5$ D are satisfied.

What is claimed is:

1. In a unipotential type electron gun for use in a cathode ray tube of the class comprising an electron emitting member which emits an electron beam of a controlled intensity under the control of an external control signal, a main electron lens adapted to focus said electron beam and constituted by three cylindrical electrodes disposed coaxially with predetermined gaps therebetween, wherein the same anode voltage is impressed upon the electrodes on both sides and a predetermined fixed focusing voltage is impressed upon an intermediate electrode, the improvement wherein the length of the intermediate electrode is set to be larger than 1.1 D, where D represents the inner diameter of said electrodes on both sides, and the sum of the length of one electrode located on the side of said electron emitting member, the length of said intermediate electrode, the gap length therebetween, the gap length between said intermediate electrode and the electrode on the opposite side is set to be within a range of from 4.0 D to 5.4 D.

2. The unipotential type electron gun according to claim 1 wherein the length of the intermediate electrode is set to be 2.5 D.

3. In an in-line type unipotential electron gun assembly for use in a color picture tube in which three electron guns are arranged in line, wherein each electron gun comprises an electron emitting member which emits an electron beam of a controlled intensity under the control of an external control signal, a main electron lens adapted to focus said electron beam and constituted by three cylindrical electrodes disposed coaxially with predetermined gaps therebetween, wherein the same anode voltage is impressed upon the electrodes on both sides and a predetermined fixed focusing voltage is impressed upon an intermediate electrode, the improvement wherein the length of the intermediate electrode is set to be larger than 1.1 D, where D represents the inner diameter of said electrodes on both sides, and the sum of the length of one electrode located on the side of said electron emitting member, the length of said intermediate electrode, the gap length therebetween, and the gap length between said intermediate electrode and the electrode on the opposite side is set to be within a range of from 4.0 D to 5.4 D.

4. The in-line type electron gun assembly according to claim 3 wherein the length of the intermediate electrode is set to be 2.5 D.

5. In a delta type unipotential electron gun assembly for use in a color picture tube in which three electron guns are arranged in delta configuration, wherein each electron gun comprises an electron emitting member which emits an electron beam of a controlled intensity under the control of an external control signal, a main electron lens adapted to focus said electron beam and constituted by three cylindrical electrodes disposed coaxially with predetermined gaps therebetween, wherein the same anode voltage is impressed upon the electrodes on both sides and a predetermined fixed focusing voltage is impressed upon an intermediate electrode, the improvement wherein the length of the intermediate electrode is set to be larger than 1.1 D, where D represents the inner diameter of said electrodes on both sides, and the sum of the length of one electrode located on the side of said electron emitting member, the length of said intermediate electrode, the gap length therebetween, and the gap length between said intermediate electrode and the electrode on the opposite side is set to be within a range of from 4.0 D to 5.4 D.

6. The delta type electron gun assembly according to claim 5 wherein the length of the intermediate electrode is set to be 2.5 D.

7. In a unipotential type electron gun for use in a cathode ray tube of the class comprising an electron emitting member which emits an electron beam of a controlled intensity under the control of an external control signal, a main electron lens adapted to focus said electron beam and constituted by three cylindrical electrodes disposed coaxially with predetermined gaps therebetween, wherein the same anode voltage is impressed upon the electrodes on both sides and a predetermined fixed focusing voltage is impressed upon an intermediate electrode, the improvement wherein the length of the intermediate electrode is set to be larger than 1.1 D to obtain a minimum spherical aberration, where D represents the inner diameter of said electrodes on both sides, and the sum of the length of one electrode located on the side of said electron emitting member, the length of said intermediate electrode, the gap length therebetween, and the gap length between said intermediate electrode and the electrode on the opposite side is set to be within a range of from 4.0 D to 5.4 D to obtain, along with said minimum spherical aberration, a substantially minimized beam current around a fixed value of the focusing voltage.

* * * * *